US010512313B2

(12) United States Patent
Takani et al.

(10) Patent No.: US 10,512,313 B2
(45) Date of Patent: Dec. 24, 2019

(54) FASTENER TAPE, SLIDE FASTENER AND FABRIC WITH FIXEDLY-ATTACHED SLIDE FASTENER

(71) Applicant: YKK Corporation, Tokyo (JP)

(72) Inventors: Go Takani, Guangdong (CN); Yuji Sasaki, Guangdong (CN)

(73) Assignee: YKK Corporation (JP)

( * ) Notice: Subject to any disclaimer, the term of this patent is extended or adjusted under 35 U.S.C. 154(b) by 29 days.

(21) Appl. No.: 15/150,338

(22) Filed: May 9, 2016

(65) Prior Publication Data

US 2016/0331088 A1 Nov. 17, 2016

(30) Foreign Application Priority Data

May 12, 2015 (CN) ..... 2015 1 0238796

(51) Int. Cl.

| | |
|---|---|
| ***A44B 19/34*** | (2006.01) |
| ***D03D 1/00*** | (2006.01) |
| ***A44B 19/12*** | (2006.01) |
| ***D03D 15/00*** | (2006.01) |
| ***D03D 13/00*** | (2006.01) |

(52) U.S. Cl.

CPC ..... *A44B 19/346* (2013.01); *D03D 1/00* (2013.01); *D03D 13/004* (2013.01); *D03D 15/0094* (2013.01); *A44B 19/12* (2013.01); *Y10T 24/252* (2015.01)

(58) Field of Classification Search

CPC ..... A44B 19/346; A44B 19/12; A44B 19/34; A44B 19/343; D10B 2501/0631; Y10T 24/252; Y10T 24/2521; D03D 15/0094; D03D 1/00

See application file for complete search history.

(56) References Cited

U.S. PATENT DOCUMENTS

| | | | | |
|---|---|---|---|---|
| 1,622,250 A * | 3/1927 | Moore | ..... | A44B 19/346 139/384 B |
| 2,195,895 A | 4/1940 | Moore | | |
| 2,236,033 A * | 3/1941 | Killmer | ..... | A44B 19/34 139/384 R |
| 2,405,902 A * | 8/1946 | Poux | ..... | A44B 19/346 139/384 B |

(Continued)

FOREIGN PATENT DOCUMENTS

| | | | | |
|---|---|---|---|---|
| CN | 103781378 A | 5/2014 | | |
| CN | 103844452 A | 6/2014 | | |
| WO | WO-2013035193 A1 * | 3/2013 | ..... | A44B 19/343 |

OTHER PUBLICATIONS

Office Action, Chinese Patent Application No. 201510238796.9, dated Aug. 15, 2018, 13 pages.

*Primary Examiner* — Robert Sandy
*Assistant Examiner* — Rowland Do
(74) *Attorney, Agent, or Firm* — Kilpatrick Townsend & Stockton LLP

(57) ABSTRACT

A fastener tape includes a mounting part for mounting a fastener element and a sewing part for sewing a fabric. The mutually adjoining sides of the mounting part and sewing part are integrally connected to each other. Another side of the mounting part which is spaced distantly from the sewing part provides a fastener element mounting side for mounting the fastener element. The sewing part is constituted of a plain weave texture.

14 Claims, 2 Drawing Sheets

(56) References Cited

U.S. PATENT DOCUMENTS

| | | | | | |
|---|---|---|---|---|---|
| 2,564,454 | A * | 8/1951 | Stohlman | D03D 3/00 | 139/383 R |
| 2,940,478 | A * | 6/1960 | Hendley | A44B 19/346 | 139/384 B |
| 2,963,047 | A | 12/1960 | Monahan | | |
| 3,822,444 | A * | 7/1974 | Johns | A44B 19/12 | 24/391 |
| 3,951,181 | A * | 4/1976 | Tsubata | A44B 19/34 | 139/384 B |
| 4,354,532 | A * | 10/1982 | Tsubata | A44B 19/346 | 139/384 B |
| 5,713,398 | A * | 2/1998 | Josef | D21F 1/0027 | 139/383 A |
| 7,152,438 | B2 * | 12/2006 | Matsuda | A44B 19/343 | 66/192 |
| 9,169,583 | B2 * | 10/2015 | Hasegawa | A44B 19/346 | |
| 9,339,088 | B2 * | 5/2016 | Tang | A44B 19/403 | |
| 9,668,549 | B2 * | 6/2017 | Tsuzuyama | A44B 19/343 | |
| 2004/0250384 | A1 * | 12/2004 | Arai | A44B 19/34 | 24/432 |
| 2011/0120588 | A1 * | 5/2011 | Shteiyer | D03D 1/0041 | 139/36 |
| 2014/0223699 | A1 | 8/2014 | Tsuzuyama | | |
| 2015/0272285 | A1 | 10/2015 | Tang | | |

* cited by examiner

FASTENER TAPE, SLIDE FASTENER AND FABRIC WITH FIXEDLY-ATTACHED SLIDE FASTENER

The present application claims priority of Chinese Patent Application No. 20151028796.9, filed on May 12, 2015 and entitled "Fastener Tape, Slide Fastener and Fabric with Fixedly-Attached Slide Fastener", the entire contents of which are hereby incorporated by reference.

TECHNICAL FIELD

The invention relates to a fastener tape, a slide fastener, and a fabric with a fixedly-attached slide fastener.

BACKGROUND

A slide fastener, normally, includes a pair of fastener tapes, a pair of fastener elements mounted on the fastener tapes, and a slider for meshing the paired fastener elements with each other. To sew together a slide fastener and a fabric such as clothing is substantially to sew together a fastener tape and a fabric. However, when a slide fastener is sewn on a relatively thin and soft fabric, due to shortage of rigidity of the fabric itself, there is a fear that, after the slide fastener is sewn, the fabric can fold.

SUMMARY

It is therefore an object of the present invention to provide a fastener tape, a slide fastener, and a fabric with a fixedly-attached slide fastener, thereby solving the problem of the conventional technology that, after the slide fastener is sewn on the fabric, due to shortage of rigidity of the fabric itself, the fabric with the slide fastener mounted thereon can fold.

According to an aspect of the embodiments of the present invention, there is provided a fastener tape, comprising: a mounting part for mounting a fastener element; and a sewing part for sewing a fabric, wherein the mutually adjoining sides of the mounting part and sewing part are integrally connected to each other, wherein another side of the mounting part which is spaced distantly from the sewing part provides a fastener element mounting side for mounting the fastener element, and wherein the sewing part is constituted of a plain weave texture. The plain weave texture of the sewing part can the fastener tape with better rigidity. When the fastener tape woven according to the above method is sewn on the fabric, the folding phenomenon of the fabric can be improved and the fabric can be prevented against folding.

To enhance the beauty of the whole fastener tape, the fastener tape further includes an end part which is positioned at another side of the sewing part which is spaced distantly from the mounting part, while the mutually adjoining sides of the end part and sewing part are integrally connected to each other.

A ratio of the widths of the mounting part, the sewing part and the end part are perpendicular to the fastener element mounting side may preferably be 5:4:3. Setting of this ratio can maintain the rigidity of the sewing part within a reasonable range, thereby enabling the fastener tape to have an effect to prevent the fabric against folding, and can maintain the flexibility of the fastener tape, thereby enabling elimination of a large influence on the smooth opening and closing operations of the fastener element by the slider.

The above end part provides two kinds of technological solutions. Specifically, they are as follows.

Firstly, the end part is constituted of a plain weave texture.

Secondly, the end part includes an end part edge segment and an end part transition segment, the end part transition segment is positioned between the sewing part and the end part edge segment, the end part transition segment is integrally connected to the mutually adjoining sides of the sewing part and the end part edge segment, and the end part transition segment is constituted of a variation texture, and the end part edge segment is constituted of a plain weave texture.

When the end part edge segment of the end part or the whole end part is constituted of a plain-woven texture, for example, the end part can be prevented against position displacement, thereby enabling the end part to look more beautiful. Also, when the end part transition segment is set in a variation texture, transition between the end part edge segment and sewing part can be facilitated.

The above mounting part provides three kinds of technological solutions. Specifically, they are as follows.

Firstly, the mounting part is constituted of a twill weave texture.

Secondly, the mounting part includes a mounting part sewing segment and a mounting part intermediate segment, the mounting part intermediate segment and mounting part sewing segment are arranged sequentially along a direction spaced distantly from the sewing part, the mutually adjoining sides among the mounting part intermediate segment, the mounting part sewing segment and the sewing part are integrally connected to each other, the fastener element mounting side is formed at one side of the mounting part sewing segment which is distantly spaced from the mounting part intermediate segment, and the mounting part sewing segment is constituted of a twill weave texture, and the mounting part intermediate segment is constituted of a plain weave texture.

Thirdly, the mounting part includes a mounting part sewing segment, a mounting part intermediate segment and a mounting part transition segment, the mounting part transition segment, the mounting part intermediate segment and the mounting part sewing segment are arranged sequentially along a direction spaced distantly from the sewing part, the mutually adjoining sides among the mounting part sewing segment, the mounting part intermediate segment, the mounting part transition segment and the sewing part are integrally connected to each other, the fastener element mounting side is formed at one side of the mounting part sewing segment which is distantly spaced from the mounting part intermediate segment, and the mounting part sewing segment is constituted of a twill weave texture, the mounting part intermediate segment is constituted of a plain weave structure, and the mounting part transition segment is constituted of a variation texture.

When the mounting part sewing segment of the mounting part or the whole mounting part is constituted of a twill weave texture, sewing of the fastener element on the mounting part can be facilitated. When the mounting part intermediate segment is constituted of a plain weave texture, position displacement between warp and weft can be prevented. When the mounting part transition segment is constituted of a variation texture, transition between the mounting part intermediate segment and sewing part can be facilitated.

As one preferred solution of the above technological solutions, the width of the sewing part along a direction perpendicular to the fastener element mounting side may be less than 50% of the width of the fastener tape along a direction perpendicular to the fastener element mounting side.

As one preferred solution of the above technological solutions, the width of the sewing part along a direction perpendicular to the fastener element mounting side may be smaller than the width of the mounting part along a direction perpendicular to the fastener element mounting side.

As one preferred solution of the above technological solutions, the diameter of the warp of the sewing part may be larger than that of the weft and, more preferably, the diameter of the warp in the sewing part may be 1.5 times to three times that of the weft.

Due to the above limit on the sewing part, the rigidity of the sewing part can be maintained in a reasonable range, thereby enabling the fastener tape to have an effect to prevent the fabric from folding, and the flexibility of the fastener tape can be maintained, thereby avoiding a large influence on the smooth opening and closing operations of the fastener element by the slider.

To realize the above object and other related objects, the invention further provides a slide fastener comprising the two symmetric fastener tapes each of which is the fastener tape described above, wherein fastener elements are mounted on the fastener element mounting sides of the mounting parts of the fastener tapes, two of the fastener elements correspond to each other and can mesh with each other, and on the two fastener elements, a slider capable of opening and closing the two fastener elements is further provided.

To realize the above object and other related objects, the invention further provides a fabric with a slide fastener fixed thereto, wherein the slide fastener described above is fixed to the fabric, the sewing part and the fabric are overlapped with each other and are sewn together by a sewing thread, and the maximum thickness of the fastener tape is 6 to 14 times the thickness of the fabric. Setting of the maximum thickness of the fastener tape in the range of 6 to 14 times the thickness of the fabric can effectively prevent the fabric from folding after the slide fastener is mounted on the fabric.

To sum up the above description, the fastener tape, slide fastener and fabric with fixedly-attached slide fastener according to the invention can provide the following useful effects.

In the fastener tape, slide fastener and fabric with fixedly-attached slide fastener, the mounting part and sewing part of the fastener tape employ different weaving methods, while the sewing part is constituted of a plain weave texture to thereby prevent position displacement between warp and weft and enhance the rigidity of the fastener tape, whereby, after a slide fastener having the above fastener tape is sewn on the fabric, the fabric can be effectively prevented from folding.

DETAILED DESCRIPTION

Figure 1:
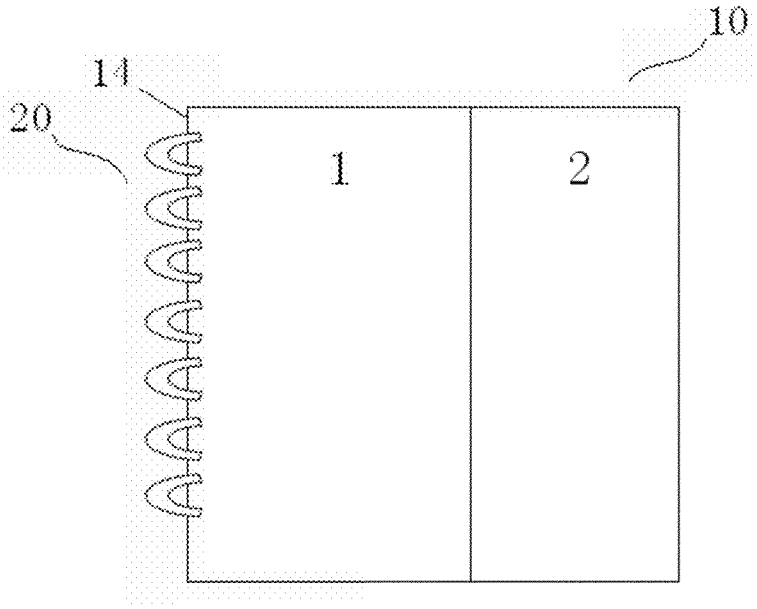
FIG. 1 is a schematic view of a structure of a fastener tape of the invention.

Description is given below of a method for enforcing the invention using a specific embodiment. A person skilled in the art can easily understand other advantages and effects of the invention from contents disclosed in the specification.

Description is given with reference to FIGS. 1 to 4. Structures, ratios, sizes and the like shown in the drawings of the specification are used to explain the contents disclosed in the specification for easy understanding of the person skilled in the art; and thus, they do not limit conditions enabling enforcement of the invention nor have substantial meaning in technology. Modifications of the structures, changes of the proportion relations or adjustments of the sizes are all contained in the range that can be covered by the technological contents disclosed in the invention, so long as they have no influence on the effects and objects of the invention. Also, terms used in the specification such as [upper], [lower], [left], [right], [intermediate] and [one] are used to explain the invention clearly but do not limit the enforceable range of the invention; and, changes or adjustments of the relative relations thereof fall under the enforceable range of the invention so long as they do not contain the substantial changes of the technological contents of the invention.

Figure 4:
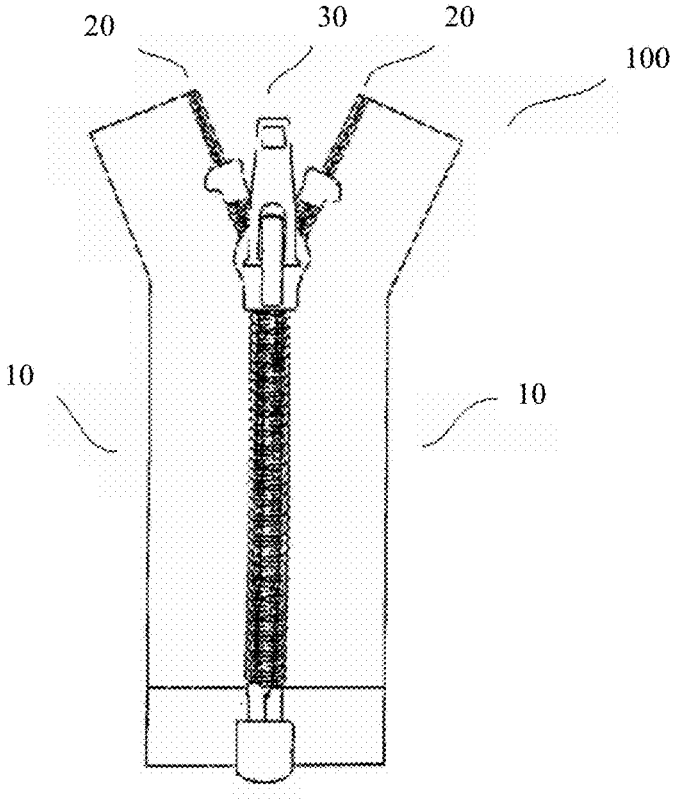
FIG. 4 is a schematic view to show how to assemble the fastener tape of FIGS. 1 to 3 to a slide fastener.

As shown in FIG. 4, a slide fastener 100 includes two symmetrical fastener tapes 10, a fastener element 20 is mounted on a fastener element mounting side 14 of a mounting part of each fastener tape 10, the two fastener elements 20 correspond to each other and are meshable with each other and, on the two fastener elements 20, there is further provided a slider 30 capable of opening and closing the two fastener elements 20.

As shown in FIG. 1, the fastener tape 10 of the invention includes a mounting part 1 for mounting the fastener element 20 and a sewing part 2 for sewing a fabric; the mutually adjoining sides of the mounting part 1 and sewing part 2 are integrally connected to each other; another side of the mounting part 1 which is distantly spaced from the sewing part 2 provides a fastener element mounting side 14 for mounting the fastener element 20; and, the sewing part 2 is constituted of a plain weave texture. The plain weave texture of the sewing part 2 enables the fastener tape 10 to have more excellent rigidity. Since the fastener tape 10 woven in the above method is sewn on the fabric, the folding phenomenon of the fabric can be improved, thereby preventing the fabric against folding.

Figure 2:
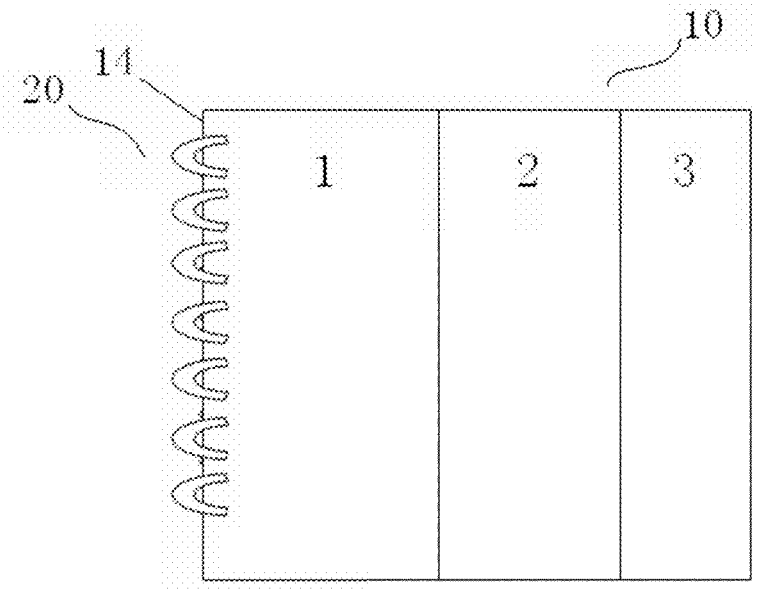
FIG. 2 is a schematic view of another structure of the fastener tape of the invention.

As shown in FIG. 2, for enhancing the beauty of the whole fastener tape 10, the fastener tape 10 further includes an end part 3, the end part 3 is positioned at another side of the sewing part 2 which is spaced distantly from the mounting part 1, and the mutually adjoining sides of the end part 3 and sewing part 2 are integrally connected to each other.

When the rigidity of the sewing part 2 is excessively large, the rigidity of the whole fastener tape 10 becomes excessively large. In order that, while preventing such excessive large rigidity, the flexibility of the fastener tape 10 can be maintained to avoid a great influence on the smooth opening and closing operations of the fastener elements 20 by the slider 30, the sewing part 2 can be limited by several methods as follows.

1) The width of the sewing part 2 in a direction perpendicular to the fastener element mounting side 14 is less than 50% of the width of the fastener tape 10 in a direction perpendicular to the fastener element mounting side 14.

2) The width of the sewing part 2 in a direction perpendicular to the fastener element mounting side 14 is smaller than the width of the mounting part 1 in a direction perpendicular to the fastener element mounting side 14.

3) The diameter of a warp 21 of the sewing part 2 is larger than the diameter of a weft 22 and, more preferably, the former may be 1.5 times to 3 times the latter.

4) When the fastener tape 10 further includes the end part 3, the ratio of the widths of the mounting part 1, sewing part 2 and end part 3 are in a direction perpendicular to the fastener element mounting side 14 is 5:4:3.

The above four limit conditions can be used singly or in combination. The sewing part 2 satisfying the above condition(s) can maintain the rigidity thereof in a reasonable range, thereby enabling the fastener tape 10 to have an effect for preventing the fabric from folding, and can maintain the flexibility of the fastener tape 10, thereby avoiding a large influence on the smooth opening and closing operation of the fastener element 20 by the slider 30.

Figure 3:
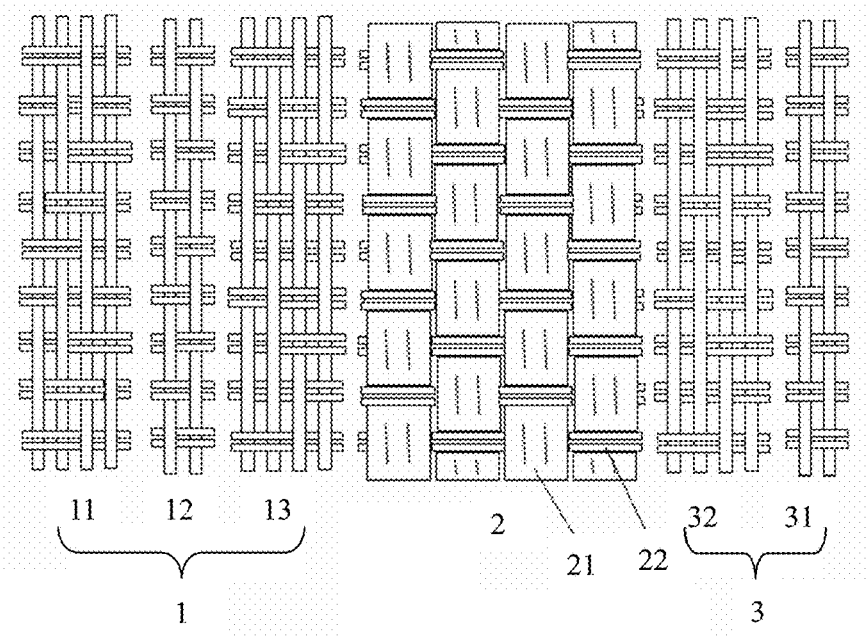
FIG. 3 is a schematic view of a specific enforcing method of the fastener tape shown in FIG. 2.

As shown in FIG. 3, the mounting part 1 provides three kinds of enforcing methods. Specifically, they are as follows.

Firstly, the mounting part 1 is constituted of a twill weave texture.

Secondly, the mounting part 1 includes a mounting part sewing segment 11 and a mounting part intermediate segment 12; the mounting part intermediate segment 12 and mounting part sewing segment 11 are arranged sequentially along a direction spaced distantly from the sewing part 2; the mutually adjoining sides of the mounting part intermediate segment 12, mounting part sewing segment 11 and sewing part 2 are integrally connected to each other; a fastener element mounting side 14 is formed in one side of the mounting part sewing segment 11 which is spaced distantly from the mounting part intermediate segment 12; the mounting part sewing segment 11 is constituted of a twill weave texture; and, the mounting part intermediate segment 12 is constituted of a plain weave texture.

Thirdly, the mounting part 1 includes a mounting part sewing segment 11, a mounting part intermediate segment 12 and a mounting part transition segment 13; the mounting part transition segment 13, mounting part intermediate segment 12 and mounting part sewing segment 11 are arranged sequentially along a direction spaced distantly from the sewing part 2; the mutually adjoining sides of the mounting part sewing segment 11, mounting part intermediate segment 12, mounting part transition segment 13 and sewing part 2 are integrally connected to each other; a fastener element mounting side 14 is formed in one side of the mounting part sewing segment 11 which is spaced distantly from the mounting part intermediate segment 12; the mounting part sewing segment 11 is constituted of a twill weave texture; the mounting part intermediate segment 12 is constituted of a plain weave texture; and the mounting part transition segment 13 is constituted of a variation texture. Here, the variation texture of the mounting part transition segment 13 is woven in the manner of [1/1, 1/1, 2/2, 2/2, 2/2, 2/2, 1/1, 1/1].

When the mounting part sewing segment 11 of the mounting part 1 or the whole mounting part 1 is set in a twill weave texture, the fastener element 20 can be sewn on the mounting part 1 easily. When the mounting part intermediate segment 12 is set in a plain weave texture, position displacement between warp and weft can be prevented. Also, employment of the variation texture in the mounting part transition segment 13 can facilitate transition between the mounting part intermediate segment 12 and sewing part 2.

As shown in FIG. 3, the end part 3 may be enforced by two kinds of methods. Specifically, they are as follows.

Firstly, the end part 3 is constituted of a plain weave texture.

Secondly, the end part 3 includes an end part edge segment 31 and an end part transition segment 32; the end part transition segment 32 is positioned between the sewing part 2 and end part edge segment 31; the end part transition segment 32 is integrally connected to the mutually adjoining sides among the sewing part 2 and the end part edge segment 31; the end part transition segment 32 is constituted of a variation texture; and, the end part edge segment 31 is constituted of a plain weave texture. Here, the weaving way of the variation texture of the end part transition segment 32 is [1/1, 2/2, 2/2, 2/2, 2/2, 2/2, 2/2, 2/2, 2/2, 1/1, 1/1].

Setting of the end part edge segment 31 of the end part 3 or the whole end part 3 in a plain weave texture can, for example, prevent position displacement and can make the end part 3 look more beautiful. Also, setting of the end part transition segment 32 in a variation weave texture can facilitate transition between the end part edge segment 31 and sewing part 2.

In the above embodiment, the extension direction of a warp is parallel to the extension direction of the fastener element mounting side 14, while a weft extends in a direction perpendicular to the fastener element mounting side 14. As shown in FIG. 3, a reference numeral 21 designates the warp of the sewing part 2, while 22 designates the weft of the sewing part 2.

As shown in FIG. 4, the invention further relates to a slide fastener. A slide fastener 100 includes two symmetrical fastener tapes 10, a fastener element 20 is mounted on the fastener element mounting side 14 of the mounting part 1 of each fastener tape 10, the two fastener elements 20 correspond to each other and can mesh with each other, and the two fastener elements 20 further include a slider 30 capable of opening and closing them.

The invention further relates to a fabric with a slide fastener fixed thereto. The slide fastener 100 is fixed to the fabric, the sewing part 2 and fabric overlap with each other and are sewn together by a sewing thread, and the maximum thickness of the fastener tape 10 is 6 to 14 times the thickness of the fabric. Here, the maximum thickness of the fastener tape 10 is the maximum value of the relative distance of the upper and lower surfaces of the fastener tape 10 in a direction perpendicular to the upper and lower surfaces of fastener tape 10 when the fastener tape 10 is placed horizontally; and, the thickness of the fabric is the relative distance of the upper and lower surfaces of the fabric in a direction perpendicular to the upper and lower surfaces of the fabric when the fabric is placed horizontally. When the maximum thickness of the fastener tape 10 is set in the range of 6 to 14 times the thickness of the fabric, after the slide fastener 100 is mounted on the fabric, the fabric can be effectively prevented from folding.

Summing up the above, in the fastener tape, slide fastener and fabric with slide fastener fixed thereto of the invention, the mounting part and sewing part of the fastener tape employ different weaving methods; and, by setting the sewing part in a plain weave texture, position displacement between warp and weft can be prevented and the rigidity of the fastener tape can be enhanced, whereby, after the slide fastener having the above fastener tapes is sewn onto the fabric, the fabric can be effectively prevented against folding. Therefore, the invention effectively overcomes various defects found in the conventional technology and thus has a high industrial utility value.

The above embodiment explains the principles and effects of the invention illustratively but does not limit the invention at all. A person skilled in the art can modify or change the embodiment without departing from the spirit and range of the invention. Therefore, all equivalent modifications and changes completed by the person skilled in the art without departing from the spirit and technological concept of the invention fall under the scope of the patent claims of the invention.

What is claimed is:

1. A fastener tape, comprising:

a mounting part for mounting a fastener element; and a sewing part for sewing a fabric; and an end part, wherein the mutually adjoining sides of the mounting part and the sewing part are integrally connected to each other, wherein another side of the mounting part which is spaced distantly from the sewing part provides a fastener element mounting side for mounting the fastener element, wherein the sewing part is constituted of a plain weave texture by a first plurality of warp yarns and a plurality of weft yarns, wherein the mounting part is constituted of a texture by a second plurality of warp yarns and the weft yarns, wherein the end part is positioned at another side of the sewing part which is spaced distantly from the mounting part, and is constituted of a texture by a third plurality of warp yarns and the weft yarns, wherein a diameter of a single warp yarn in the sewing part is larger than a diameter of a single weft yarn in the sewing part, and wherein the diameter of the single warp yarn in the sewing part is larger than a diameter of a single warp yarn in the mounting part, and is larger than a diameter of a single warp yarn in the end part.

2. The fastener tape according to claim 1, further including an end part, the mutually adjoining sides of the end part and sewing part are integrally connected to each other.

3. The fastener tape according to claim 2, wherein a ratio of the widths of the mounting part, the sewing part and the end part along a direction perpendicular to the fastener element mounting side is 5:4:3.

4. The fastener tape according to claim 2, wherein the end part is constituted of a plain weave texture.

5. The fastener tape according to claim 2, wherein the end part includes an end part edge segment and an end part transition segment, wherein the end part transition segment is positioned between the sewing part and the end part edge segment, wherein the end part transition segment is integrally connected to the mutually adjoining sides of the sewing part and the end part edge segment, wherein the end part transition segment is constituted of a variation texture, and the end part edge segment is constituted of a plain weave texture, and wherein a weaving way of the variation texture of the end part transition segment is [1/1, 2/2, 2/2, 2/2, 2/2, 2/2, 2/2, 2/2, 2/2, 1/1, 1/1].

6. The fastener tape according to claim 1, wherein the mounting part is constituted of a twill weave texture.

7. The fastener tape according to claim 1, wherein the mounting part includes a mounting part sewing segment and a mounting part intermediate segment, wherein the mounting part intermediate segment and mounting part sewing segment are arranged sequentially along a direction spaced distantly from the sewing part, wherein the mutually adjoining sides among the mounting part intermediate segment, the mounting part sewing segment and the sewing part are integrally connected to each other, wherein the fastener element mounting side is formed at one side of the mounting part sewing segment which is spaced distantly from the mounting part intermediate segment, and wherein the mounting part sewing segment is constituted of a twill weave texture, and the mounting part intermediate segment is constituted of a plain weave texture.

8. The fastener tape according to claim 1, wherein the mounting part includes a mounting part sewing segment, a mounting part intermediate segment and a mounting part transition segment, wherein the mounting part transition segment, the mounting part intermediate segment and the mounting part sewing segment are arranged sequentially along a direction spaced distantly from the sewing part, wherein the mutually adjoining sides among the mounting part sewing segment, the mounting part intermediate segment, the mounting part transition segment and the sewing part are integrally connected to each other, wherein the fastener element mounting side is formed at one side of the mounting part sewing segment which is spaced distantly from the mounting part intermediate segment, wherein the mounting part sewing segment is constituted of a twill weave texture, the mounting part intermediate segment is constituted of a plain weave texture and the mounting part transition segment is constituted of a variation texture, and wherein a weaving way of the variation texture of the mounting part transition segment is [1/1, 1/1, 2/2, 2/2, 2/2, 2/2, 1/1, 1,1].

9. The fastener tape according to claim 1, wherein the width of the sewing part along a direction perpendicular to the fastener element mounting side is less than 50% of the width of the fastener tape along a direction perpendicular to the fastener element mounting side.

10. The fastener tape according to claim 1, wherein the width of the sewing part along a direction perpendicular to the fastener element mounting side is smaller than the width of the mounting part along a direction perpendicular to the fastener element mounting side.

11. The fastener tape according to claim 1, wherein the diameter of the single warp yarn in the sewing part is 1.5 times to 3 times the diameter of the single weft yarn in the sewing part.

12. A slide fastener comprising two symmetrical fastener tapes each of which is the fastener tape according to claim 1, wherein fastener elements are respectively mounted on the fastener element mounting sides of the mounting parts of the fastener tapes, wherein two of the fastener elements correspond to each other and can mesh with each other, and wherein on the two fastener elements, a slider capable of opening and closing the two fastener elements is further provided.

13. A fabric with a fixedly-attached slide fastener, wherein the slide fastener according to claim 12 is fixed to the fabric, wherein the sewing part and the fabric overlap with each other and are sewn together by sewing threads, and wherein the maximum thickness of the fastener tape is 6 to 14 times the thickness of the fabric.

14. The fastener tape according to claim 1, further comprising:

fastener elements mounted on the mounting part.

* * * * *